US007967111B2

(12) United States Patent
Meyers et al.

(10) Patent No.: US 7,967,111 B2
(45) Date of Patent: Jun. 28, 2011

(54) STEPLADDER

(75) Inventors: Thomas J. Meyers, Greenwood, IN (US); Wyatt Compton, Garretson, SD (US); Paul T. Zink, Indianapolis, IN (US)

(73) Assignee: Cosco Management, Inc., Wilmington, DE (US)

( * ) Notice: Subject to any disclaimer, the term of this patent is extended or adjusted under 35 U.S.C. 154(b) by 578 days.

(21) Appl. No.: 11/956,787

(22) Filed: Dec. 14, 2007

(65) Prior Publication Data

US 2008/0142301 A1 Jun. 19, 2008

Related U.S. Application Data

(60) Provisional application No. 60/870,464, filed on Dec. 18, 2006.

(51) Int. Cl.
*E06C 7/00* (2006.01)

(52) U.S. Cl. ..... 182/129; 182/165; 182/161; 182/180.1

(58) Field of Classification Search ..... 182/129, 182/165, 161, 180.1, 33, 115; 297/162, 173, 297/41; 312/322; 280/163
See application file for complete search history.

(56) References Cited

U.S. PATENT DOCUMENTS

| | | | | |
|---|---|---|---|---|
| 0,162,075 | A | 4/1875 | Isaacs et al. | |
| 5,531,159 | A | 7/1996 | Stubblefield | 108/102 |
| 5,722,507 | A | 3/1998 | Kain | |
| 5,903,380 | A | 5/1999 | Motamedi et al. | |
| 6,039,149 | A | 3/2000 | Bedja et al. | 182/20 |
| 6,427,805 | B1 | 8/2002 | Gibson et al. | 182/165 |
| 6,550,579 | B2 | 4/2003 | Gibson et al. | |
| 6,902,034 | B2 | 6/2005 | Gibson et al. | 182/129 |
| 7,108,103 | B2 | 9/2006 | Meeker | 182/165 |
| 7,128,187 | B2 | 10/2006 | Simpson | 182/129 |
| 7,182,176 | B2 | 2/2007 | Gibson et al. | 182/129 |
| 2003/0057022 | A1 | 3/2003 | Leng | 182/165 |
| 2003/0209387 | A1 | 11/2003 | Burr | 182/129 |

*Primary Examiner* — Katherine Mitchell
*Assistant Examiner* — Daniel Cahn
(74) *Attorney, Agent, or Firm* — Barnes & Thornburg LLP

(57) ABSTRACT

A stepladder includes a step frame having legs and steps and a tray unit coupled to the step frame. The tray unit includes a utility tray mounted for pivotable movement relative to the step frame.

19 Claims, 6 Drawing Sheets

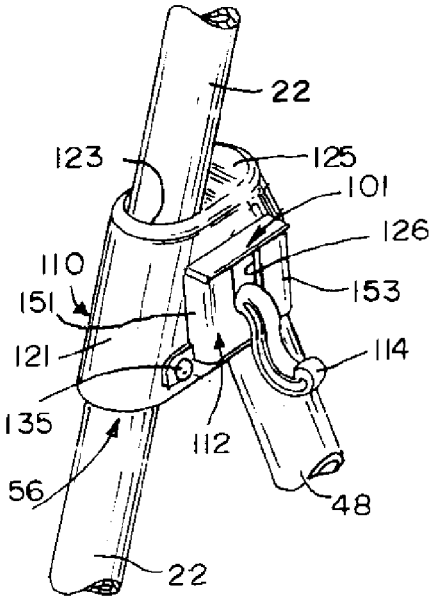
FIG. 11
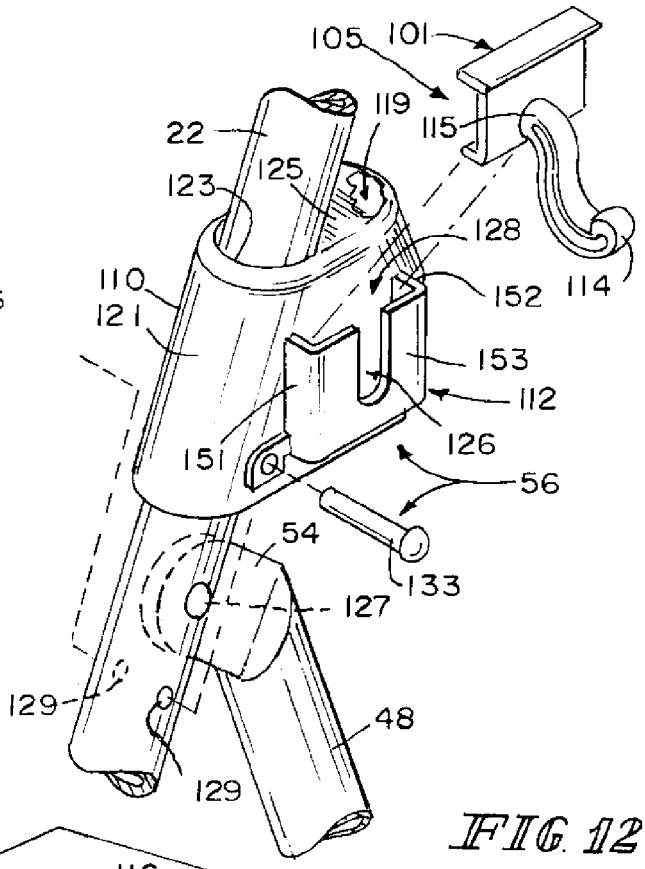
FIG. 12
FIG. 13
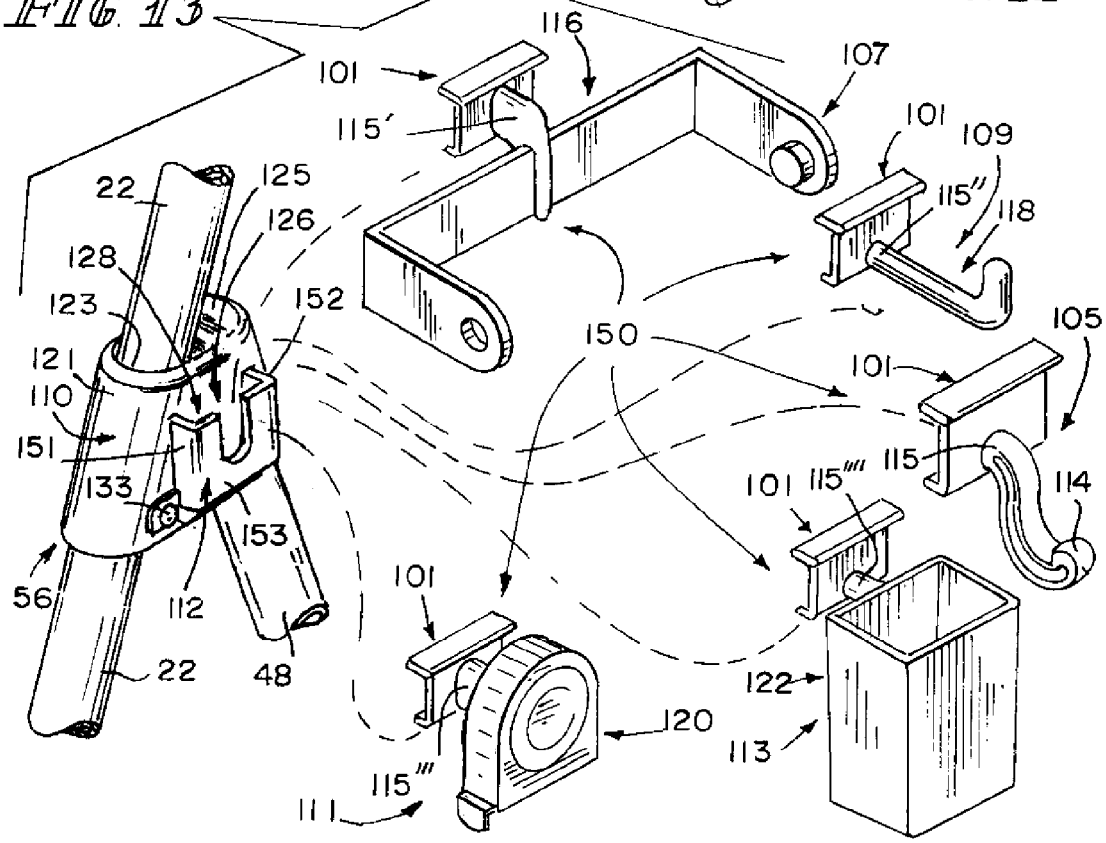

STEPLADDER

This application claims priority under 35 U.S.C. §119(e) to U.S. Provisional Application Ser. No. 60/870,464, filed Dec. 18, 2006, which is expressly incorporated by reference herein.

BACKGROUND

The present disclosure relates to ladders and particularly to stepladders. More particularly, the present disclosure relates to a folding stepladder including a tray and a step mount system.

Stepladders have a frame and one or more steps that people use for elevation when reaching for objects, painting walls, or any everyday task where extra elevation would be helpful. Stepladders are often foldable for ease of storage when the stepladder is not being used.

SUMMARY

According to the present disclosure, a foldable stepladder includes a step frame coupled to a relatively shorter stabilizer frame for folding movement relative to the step frame between an expanded use position and a collapsed storage position. The stepladder also includes a pivotable utility tray mounted on the step frame for movement relative to the step frame between use and storage positions.

In illustrative embodiments, the utility tray is movable independent of the folding action of the frames. In one illustrative embodiment, the utility tray is mounted for pivoting and sliding movement relative to the legs of the step frame. The utility tray is mounted to pivot about an axis relative to the legs of the step frame between a horizontal use position and an extended intermediate position. The utility tray is also mounted to slide back and forth along the legs of the step frame between an extended intermediate position and a retracted storage position.

In illustrative embodiments, an accessory mount is also included in the stepladder and is configured to receive a variety of separate fixtures included in an accessory kit to assist a user such as, for example, an electrical cord hook, a paper towel holder, a brush holder, or other devices to hold tools or implements. The accessory mount is configured to use a friction fit to retain the variety of fixtures in a mounted position thereon.

In illustrative embodiments, the stabilizer frame further includes a first hinge providing means for coupling a first leg of the stabilizer frame to a first leg of the step frame to support the stabilizer frame for pivotable movement about a frame pivot axis relative to the step frame. The first hinge includes a hinge pin coupled to the first legs of the step and stabilizer frames and a hinge-pin mount mated to the step and stabilizer frames and configured to carry the hinge pin. The first hinge also includes the accessory mount and the accessory mount is coupled to the hinge-pin mount in illustrative embodiments.

An illustrative step mount system provided in accordance with the present disclosure comprises a strap and a fastener for coupling the strap to a step to trap a rung of the step frame in a rung receiver formed in the step. The strap and fastener cooperate to trap the mount rung between the step and the strap yet allow pivoting movement of the step about a pivot axis established by the mount rung.

Additional features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompany figures in which.

FIG. 11 is a perspective view of a first hinge-pin mount included in the foldable stepladder and showing an accessory mount coupled to an outer portion of the first hinge-pin mount and a removable utility hook coupled to the accessory mount;

FIG. 12 is a perspective view similar to FIG. 11 showing installation of the first hinge-pin mount on one of the legs of the step frame and installation of the utility hook on the accessory mount; and FIG. 13 is an exploded perspective view of illustrative stepladder accessories (e.g., a paper towel holder, a tape measure, a cord hook, and an instrument holder) included in an accessory kit and configured to be coupled, one at a time, to the accessory mount coupled to the first hinge-pin mount.

DETAILED DESCRIPTION

Figures 1, 2, 3:
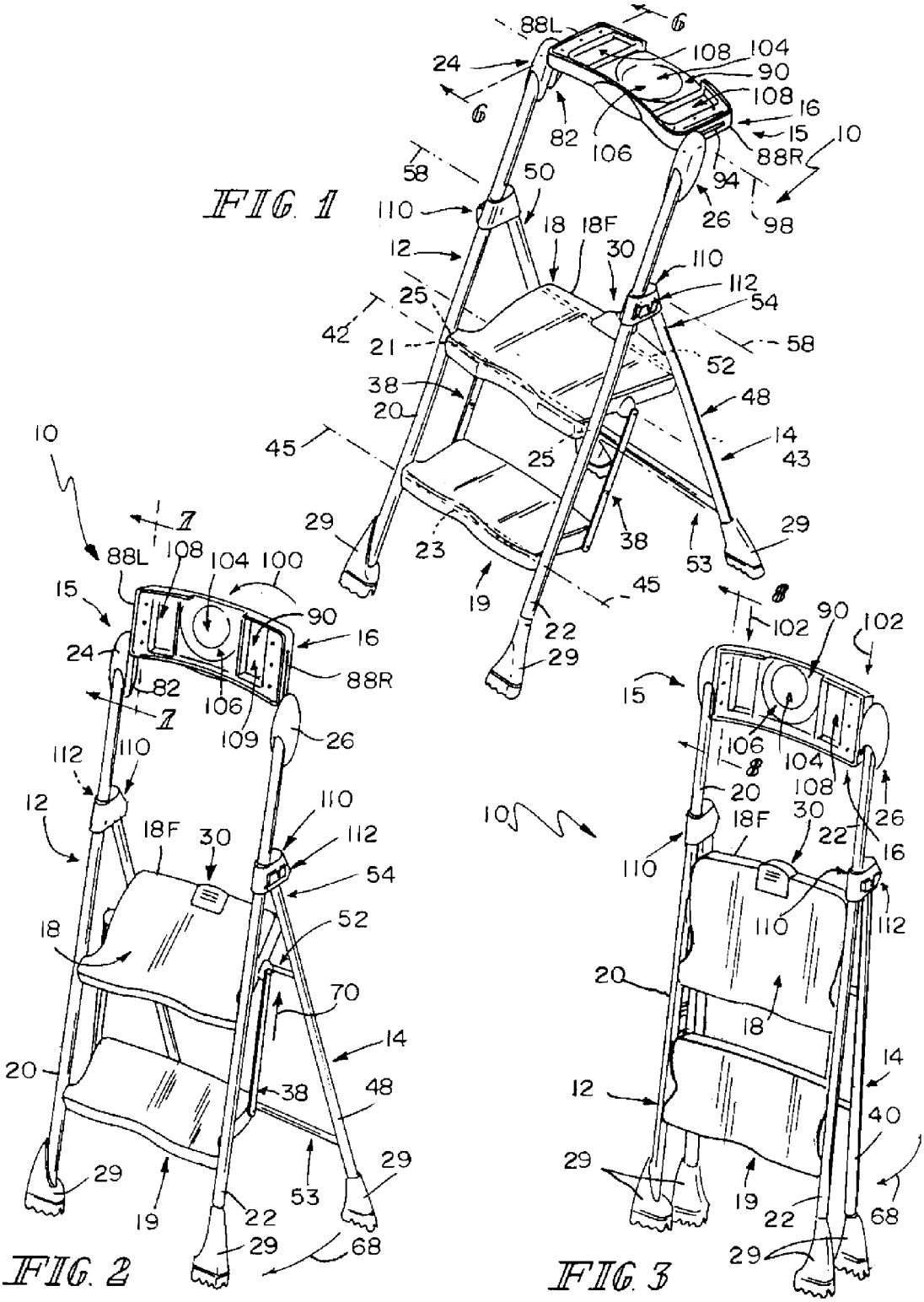
FIG. 1 is a perspective view of a stepladder in accordance with the present disclosure showing a step frame including legs, feet, steps, and step-support apparatus, a relatively shorter stabilizer frame including legs, rungs, and feet, and a tray unit mounted to the top of the step frame and formed to include a utility tray supported for, in separate stages, pivoting movement and sliding movement relative to the step frame as suggested in FIGS. 6-8 "independent" of the folding action of the frames.
FIG. 2 is another perspective view of the stepladder of FIG. 1 showing movement of the frames toward one another as the stepladder is folded to change from an expanded use position shown in FIG. 1 to a collapsed storage position shown in FIG. 3 and showing a "first stage" of movement of the utility tray relative to the step frame after the utility tray has been pivoted in a "counterclockwise" direction to move from a horizontal use position shown in FIG. 1 to assume an extended intermediate position.
FIG. 3 is a perspective view of the stepladder of FIG. 1 showing the stepladder after it has been folded to assume the collapsed storage position and showing a "second stage" of movement of the utility tray relative to the step frame after the utility tray has been moved downwardly along legs included in the step frame from the extended intermediate position shown in FIG. 2 to assume a retracted storage position.

A stepladder 10 includes a step frame 12, a relatively shorter stabilizer frame 14, and a pivotable and slidable utility tray 16 included in a tray unit 15 coupled to a top end of step frame 12 as shown in FIG. 1. Step frame 12 and stabilizer frame 14 are pivotably coupled to one another to move from an expanded "use" position shown in FIG. 1 toward a collapsed "storage" position shown in FIG. 3. Utility tray 16 is movable (e.g., pivotable and slidable) in two stages independent of any folding action of step frame 12 and stabilizer frame 14 as suggested in FIGS. 1-3 and FIGS. 6-8. It is within the scope of this disclosure to include tray unit 15 in any suitable folding or non-folding ladder. Stabilizer frame 14 includes a hinge system 56, 57 associated with step frame 12 and formed to include an accessory mount 112 configured to mate, one at a time, with each of the accessories included in an accessory kit 150 as shown, for example, in FIGS. 11-13.

Figure 4:
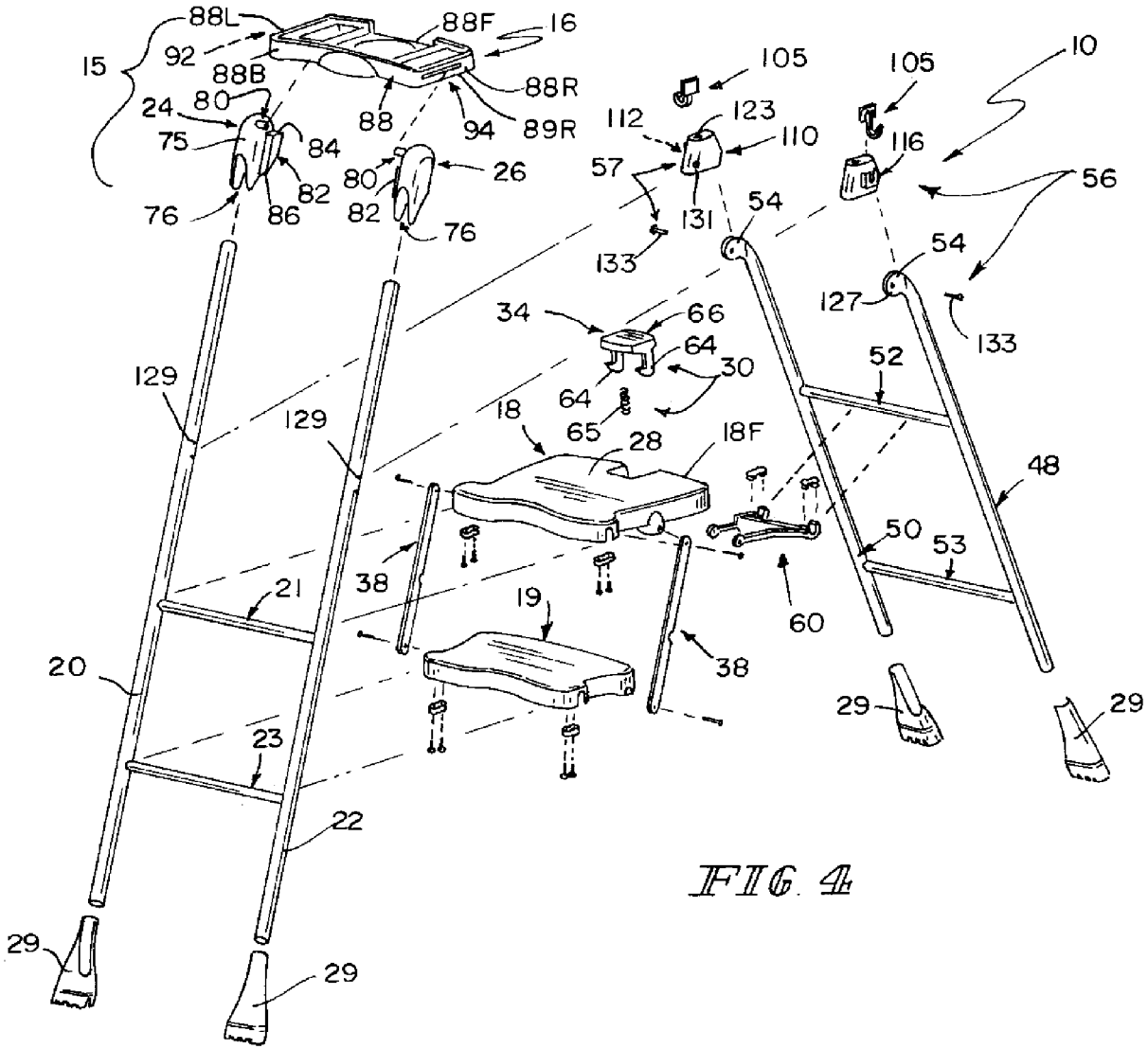
FIG. 4 is an exploded perspective view of illustrative components included in the stepladder of FIG. 1 showing that the tray unit includes separate stationary left and right tray mounts configured to be mounted on left and right legs included in the longer step frame and a movable utility tray configured to be mounted on the left and right tray mounts for pivoting and sliding movement relative to the step frame as suggested in FIGS. 1-3.

Step frame 12 includes a top step 18, lower step 19, a left leg 20, a right leg 22, and a pair of mount rungs 21, 23 extending between and interconnecting left and right legs 20, 22 as shown in FIGS. 1 and 4. A rear portion of top step 18 is configured to be coupled to upper mount rung 21 while a rear portion of lower step 19 is configured to be coupled to lower mount rung 23 as suggested in FIGS. 1 and 4.

Figure 9:
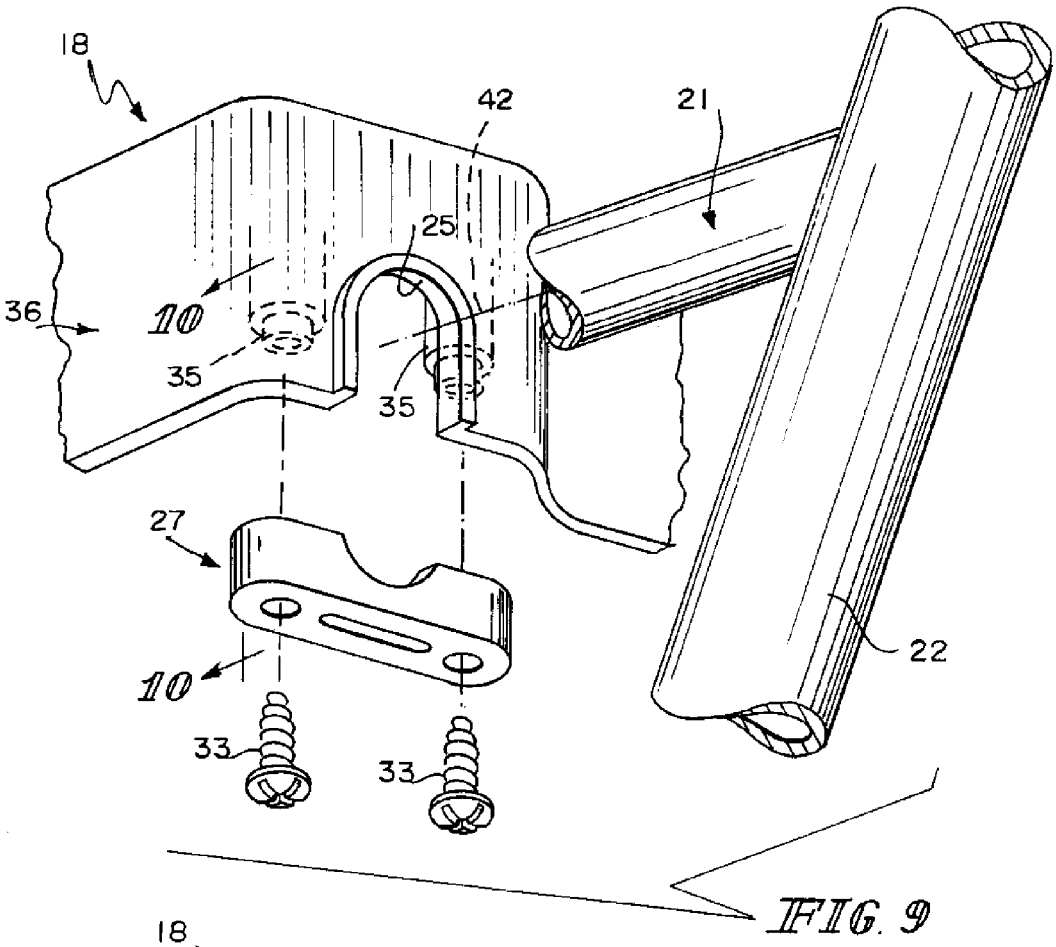
FIG. 9 is an exploded perspective view of illustrative components included in a step mount system including a strap which couples to an adjacent step to mount a step to an adjacent rung.
Figure 10:
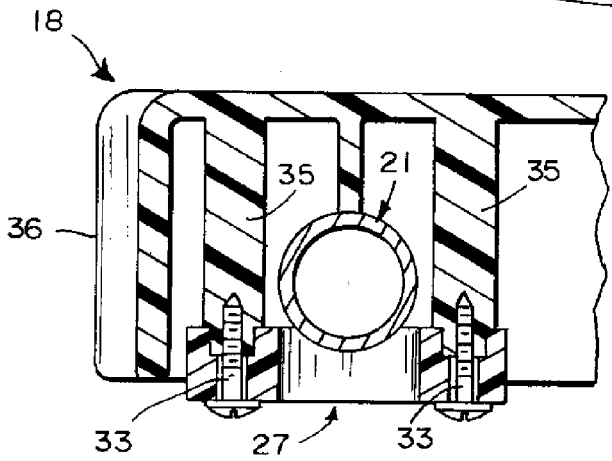
FIG. 10 is a sectional view taken along line 10-10 of FIG. 9 showing the strap coupled to a companion step to secure the step to a companion rung.

Downwardly extending lip 36 of top step 18 is formed to include a pair of U-shaped rung receivers 25 sized to receive mount rung 21 therein as suggested in FIGS. 1, 9, and 10. Step 18 is also formed to include a pair of interior strap mounts 35 associated with each rung receiver 25. A strap 27 mates with mount rung 21 and is coupled to strap mounts 35 using fasteners 33 as suggested in FIGS. 9 and 10 to trap mount rung 21 between step 18 and strap 27 yet allow pivoting movement of step 18 about a pivot axis 42 established by mount rung 21. Lower step 19 is mounted for pivotable movement about pivot axis 45 on mount rung 23 using similar means and structure.

Top step 18 is configured, in an illustrative embodiment, to provide bracing means to inhibit undesired collapsing when stepladder 10 is in the expanded use position as shown in FIG. 1. Step frame 12 also includes a foot 29 coupled to a lower end of each of legs 20, 22 as suggested in FIGS. 1-4. Step frame 12 is illustrative and any suitable frame can be used in combination with tray unit 15 in accordance with the present disclosure.

Tray unit 15 further includes a left (first) tray mount 24 and a right (second) tray mount 26 as suggested in FIGS. 1 and 4. Tray mounts 24, 26 cooperate to provide tray-controller means for supporting utility tray 16 for pivoting movement about a pivot axis 98 during a first stage of movement relative to step frame 12 and for sliding movement relative to pivot axis 98 during a second stage of movement so that utility tray 16 can be moved by a user relative to step frame 12, in series, among a horizontal use position, an extended intermediate position, and a retracted storage position (as suggested in FIGS. 6-8) independent of any folding action of frames 12, 14 included in stepladder 10.

Left and right tray mounts 24, 26 are coupled to the top of left and right legs 20, 22, respectively, and to utility tray 16 as suggested in FIGS. 1-3. Left tray mount 24 and right tray mount 26 are similar to one another in structure and function so that the description of left tray mount 24 herein applies to right tray mount 26 as well.

Each tray mount 24, 26 includes a cap 74, a pivot post 80 coupled to cap 74, and a tray brace 82 appended to cap 74 as shown, for example, in FIG. 4. Cap 74 is configured to be mounted in a stationary position on one of legs 20, 22 included in step frame 12. An enlarged view of an illustrative cap 74, pivot post 80, and tray brace 82 included in left tray mount 24 is shown in FIG. 5.

Figure 5:
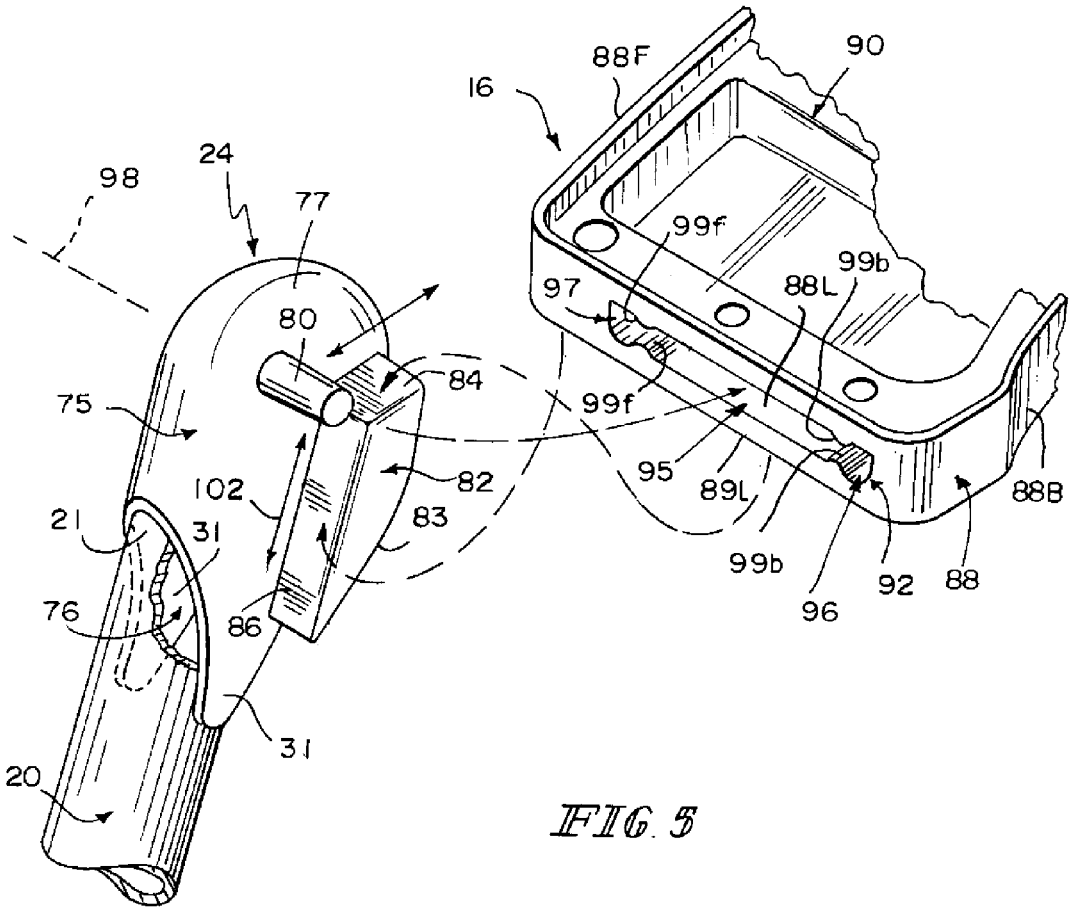
FIG. 5 is an enlarged perspective view of a portion of the stepladder of FIGS. 1-4 showing that the left tray mount is coupled to a top end of the left leg of the step frame, the left tray mount includes a cap coupled to the left leg, a tray brace coupled to the cap, and a pivot post coupled to the cap and arranged to lie adjacent to the tray brace and showing a post-receiver slot formed in a side wall of the utility tray and adapted to receive the pivot post of the left tray mount to facilitate pivoting and sliding movement of the utility tray relative to the left tray mount and the left leg.

As suggested in FIGS. 4 and 5, cap 75 is hollow and is formed to include an interior region 76 sized to receive a top end 21 of left leg 20. Cap 75 is retained in a fixed position on top end 21 of left leg 20 (or any other suitable location on step frame 12) using any suitable means. As suggested in FIG. 5, cap 75 is helmet-shaped. Each cap 75 includes a dome 77 and a pair of somewhat V-shaped side walls 31 coupled to a lower portion of dome 77 and arranged to extend downwardly as suggested in FIG. 5.

Each pivot post 80 is cantilevered to dome 77 of cap 75 and arranged to extend away from interior region 76 of cap 75 as suggested in FIG. 4. In an illustrative embodiment, pivot post 80 has a frustoconical shape as shown best in FIG. 5. Pivot posts 80 included in left and right tray mounts 24, 26 are arranged to extend toward one another along an imaginary line when caps 75 are mounted on legs 20, 22 to establish a pivot axis 98 along that imaginary line for utility tray 16 as suggested in FIGS. 1 and 6-8. Pivot posts 80 cooperate to provide means for supporting utility tray 16 for pivotable movement about pivot axis 98 during a first stage of movement of utility tray 16 relative to step frame 12 as suggested in FIGS. 6 and 7.

Figure 6:
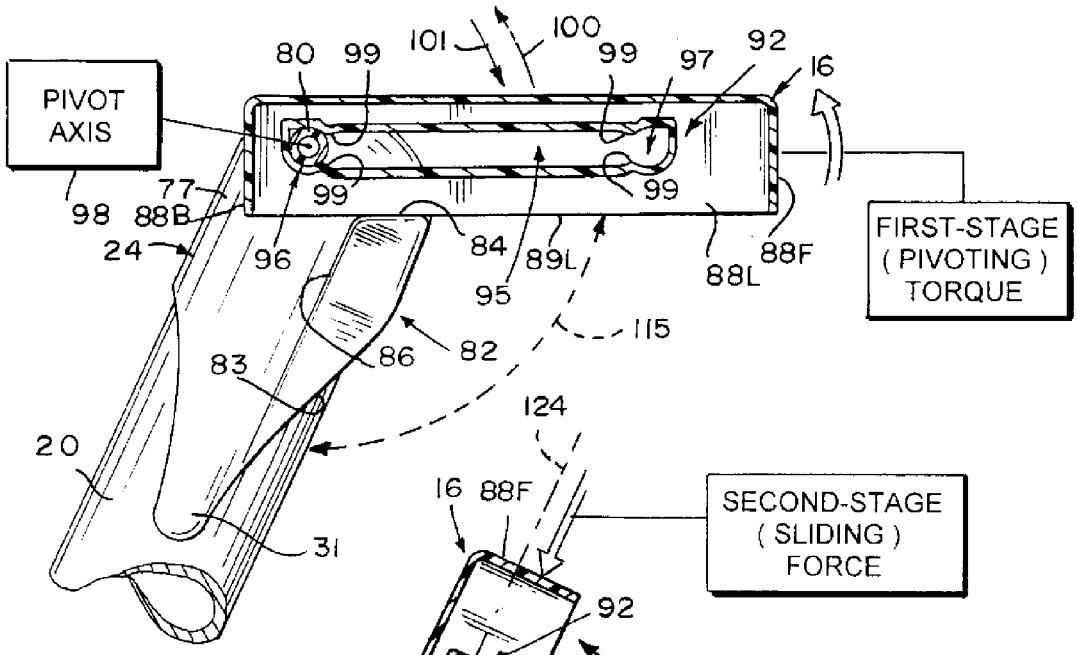
FIG. 6 is an enlarged partial sectional view taken along line 6-6 of FIG. 1 showing the utility tray oriented to lie in a horizontal use position at an obtuse angle of about 115° relative to the left leg included in the step frame.

Each tray brace 82 is configured and arranged to provide horizontal platform means for supporting utility tray 16 in the horizontal use position relative to left and right tray mounts 24, 26 as suggested, for example, in FIGS. 1 and 6. Each tray brace 82 is also configured and arranged to provide inclined platform means for supporting utility tray 16 for sliding movement relative to dome 77 of a companion cap 75 coupled to step frame 12 between an extended intermediate position shown, for example, in FIG. 7 and a retracted storage position shown, for example, in FIG. 8. Tray brace 82 includes a first planar surface 84, a second planar surface 86, and an obliquely shaped outwardly facing surface 83 as suggested in FIGS. 5-8. Outwardly facing surface 83 extends generally along an exterior edge of one of V-shaped walls 31 of cap 75 as suggested in FIGS. 6 and 7. Tray brace 82 is positioned to lie below and in a spaced-apart relation to pivot post 80 as suggested in FIGS. 5 and 6.

First planar surface 84 of tray brace 82 provides a horizontal platform that is arranged to lie in a generally horizontal orientation when stepladder 10 is positioned in the expanded use position as suggested in FIGS. 1 and 6. Second planar surface 86 of tray brace 82 provides an inclined platform that is inclined and arranged to extend downwardly away from first planar surface 84 to define an included angle therebetween of about 115° as suggested in the illustrative embodiment shown in FIG. 6. Second planar surfaces 86 of left and right tray mounts 24, 26 cooperate to support utility tray 16 for sliding movement relative to pivot axis 98 during a second stage of movement relative to step frame 12 as suggested in FIGS. 7 and 8. Pivot post 80 and second planar surface 86 cooperate to constrain motion of utility tray 16 to follow an inclined path 124 relative to cap 75 during movement of utility tray 16 from the extended intermediate position shown in FIG. 7 toward the retracted storage position shown in FIG. 8.

Utility tray 16 is coupled to left and right tray mounts 24, 26 to allow and control movement of utility tray 16 between a horizontal use position shown in FIG. 1 to a retracted storage position shown in FIG. 3. Utility tray 16 includes a side wall 88 depending from and surrounding an interior plate wall 90 of utility tray 16. Side wall 88 includes, in series, a left-side section 88L, a back section 88B, a right-side section 88R, and a front section 88F as suggested in FIG. 4.

Figure 7:
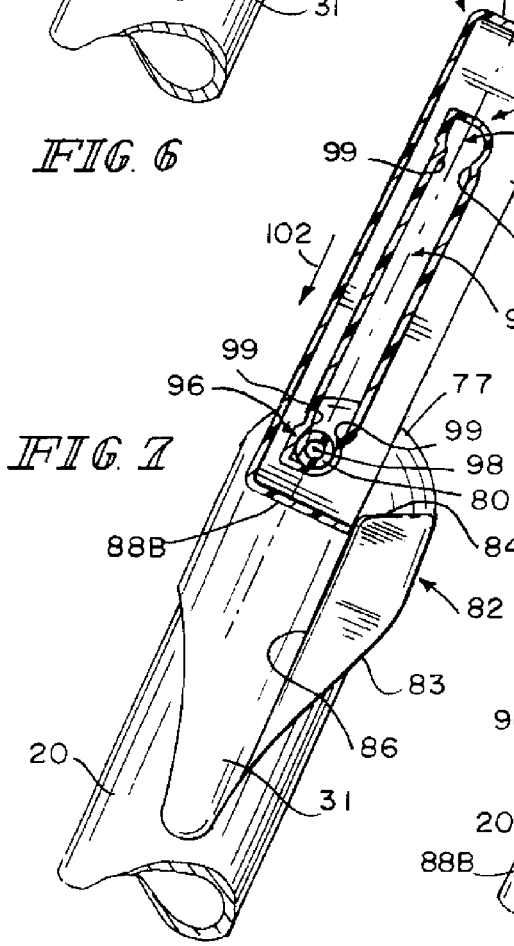
FIG. 7 is an enlarged partial sectional view taken along line 7-7 of FIG. 2 showing the utility tray after it has been pivoted about a pivot axis established by the pivot post included in the left tray mount in a counterclockwise direction relative to the left leg in the step frame in response to application of a first-stage (pivoting) torque to the utility by a user to cause the utility tray to move to assume an "inclined" extended intermediate position.
Figure 8:
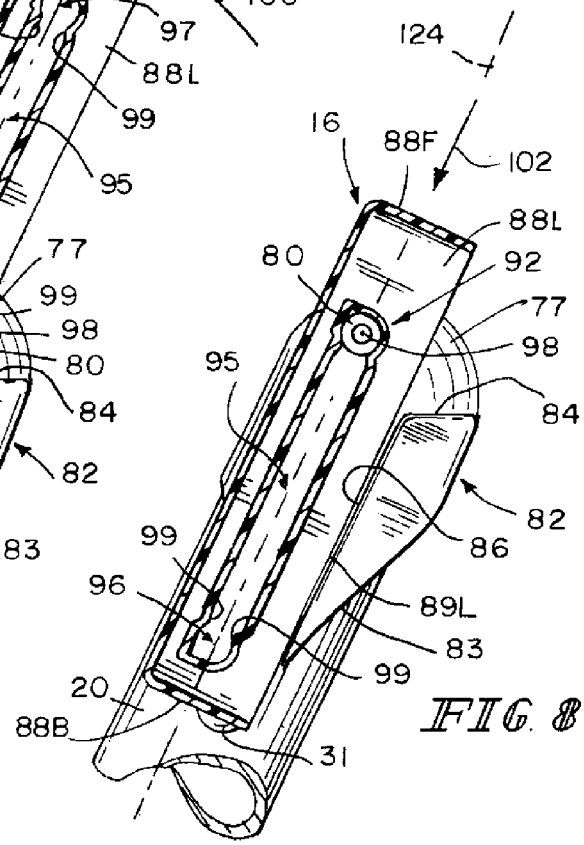
FIG. 8 is an enlarged partial sectional view taken along line 8-8 of FIG. 3 showing the utility tray in the retracted storage position after it has been slid downwardly from the extended intermediate position shown in FIG. 7 along an inclined slide path established by mating engagement of the utility tray, pivot post, and tray brace in response to application of a second-stage (sliding) force to the utility tray by a user to cause the utility tray to move to assume the retracted storage position.

As shown best in FIG. 5, left-side section 88L of side wall 88 of utility tray 16 is formed to include a left post-receiver slot 92 sized and shaped to receive pivot post 80 of left tray mount 24 therein during movement of utility tray 16 relative to step frame 12 between the horizontal use position, the extended intermediate position, and the retracted storage position as suggested in FIGS. 6-8. Similarly, right-side section 88R of side wall 88 of utility tray 16 is formed to include a right post-receiver slot 94 sized and shaped as suggested in FIGS. 1 and 4 to receive pivot post 80 of right tray mount 26 therein during movement of utility tray 16 relative to step frame 12 as suggested in FIGS. 1-3.

As suggested in FIG. 5, left-side section 88L is formed to include a first post receiver 96 in a back end portion of utility tray 16 near back section 88B of side wall 88 and a second post receiver 97 in an opposite front end portion of utility tray 16 near front section 88F of side wall 88. Left-side section 88L also is formed to include an oblong elongated guide channel 95 extending between and interconnecting first and second post receivers 96, 97 as suggested in FIG. 5.

Left-side section 88L also includes a first set of detents 99*b* arranged to extend into left post-receiver slot 92 and toward one another as suggested in FIG. 5 to define first partition means for separating guide channel 95 from first post receiver 96 yet allowing pivot post 80 to pass through a space provided in left post-receiver slot 92 between detents 99*b* as pivot post 80 moves between guide channel 95 and first post receiver 96. Detents 99*b* cooperate to provide means for temporarily retaining pivot post 80 of left tray mount 24 in first post receiver 96 while utility tray 16 is oriented to lie in the horizontal use position as shown in FIG. 6 and during first-stage pivoting movement of utility tray 16 relative to step frame 12 about pivot axis 98 as suggested in FIGS. 6 and 7.

Left-side section 88L also includes a second set of detents 99*f* arranged to extend into left post-receiver slot 92 and toward one another as also suggested in FIG. 5 to define second partition means for separating guide channel 95 from second post receiver 97 yet allowing pivot post 80 to pass through a space provided in left post-receiver slot 92 between detents 99*f* as pivot post 80 moves between guide channel 95 and second post receiver 97. Detents 99*f* cooperate to provide means for temporarily retaining pivot post 80 of left tray mount 24 in second post receiver 96 after sliding movement of utility tray 16 relative to step frame 12 along path 124 to block unwanted relative movement of utility tray 16 and step frame 12 after arrival of utility tray 16 at the retracted storage position as suggested in FIG. 8.

When utility tray 16 is moved to the horizontal use position it cooperates with step frame 12 to define an obtuse angle 115 therebetween as shown best in FIG. 6. In the horizontal use position of FIG. 6, at least a portion of a lower edge 89L of left-side section 88L of side wall 88 of utility tray 16 rests on and is supported by first planar surface 84 of tray brace 82 of left tray mount 24 to block further pivotable movement of utility tray 16 in a clockwise direction 101 about pivot axis 98 relative to step frame 12. Similarly, in the horizontal use position, at least a lower edge 89R (see FIG. 4) of right-side section 88R of side wall 88 of utility tray 16 rests on and is supported by first planar surface 84 of tray brace 82 of right tray mount 24 to help block pivotable movement of utility tray 16 in clockwise direction 101 about pivot axis 98 relative to step frame 12.

In operation, to move utility tray 16 from the horizontal use position toward the retracted storage position, the user pivots utility tray 16 about pivot axis 98 in a counterclockwise direction 100 relative to step frame 12 to assume an "inclined" extended intermediate position as shown in FIGS. 2 and 7. To move utility tray 16 from the extended intermediate position toward the retracted storage position, the user moves utility tray 16 downwardly in a direction 102 along inclined path 124 established on step frame 12. During such movement, each pivot post 80 leaves its companion first post receiver 96 and passes through the companion guide channel 95 in a direction toward the companion second post receiver 97. In the retracted storage position, at least a portion of lower edge 89L of side wall 88L confronts second planar surface 86 to block further pivotable movement in a clockwise direction relative to step frame 12 as suggested in FIG. 8.

As suggested in FIG. 4, step frame 12 further includes a first step link 60, a pair of second step links 38, and a step lock 30. Step links 38 and 60 cooperate to control movement of steps 18 and 19 relative to frames 12, 14 during folding and unfolding of frames 12, 14. Reference is made to U.S. Pat. No. 6,550,579, which reference is hereby incorporated by reference herein, for disclosures relating to motion control and locking control of steps included in a foldable stepladder 10.

First step link 60 is adapted to be coupled to top step 18 and to a strut 52 included in stabilizer frame 14 to coordinate movement of top step 18 and stabilizer frame 14 during folding and unfolding of frames 12, 14. Each second step link 38 is adapted to be coupled to top step 18 and to lower step 19 to coordinate movement of steps 18, 19 relative to frames 12, 14 during folding and unfolding of frames 12, 14 as suggested in FIGS. 1-3.

Stabilizer frame 14 includes a first support member or leg 48, a second support member or leg 50, an anchor rung 52, and a lower rung 53, as shown, for example, in FIG. 4. Anchor and lower rungs 52, 53 lie in spaced-apart relation to one another and extend between and interconnect first and second support members 48, 50 as suggested in FIGS. 2 and 4. Stabilizer frame 14 further includes a foot 29 coupled to a bottom end of each of support members 48, 50.

First and second hinges 56, 57 are included in stabilizer frame 14 of foldable stepladder 10 as suggested in FIG. 4. Each hinge 56, 57 includes a hinge pin 109 and a hinge-pin mount 110 as suggested in an illustrative embodiment shown in FIG. 4. Hinges 56, 57 function to allow stepladder 10 to be reconfigured to change from the collapsed storage position shown in FIG. 3 where step frame 12 and stabilizer frame 14 are arranged to lie in a generally parallel relation to one another to the expanded use position shown in FIG. 3 where step frame 12 and stabilizer frame 14 are arranged to lie in a splayed or non-parallel relation to one another as shown in FIG. 1.

Step lock 30 includes a pivotable latch 34 having a pair of latch hooks 64 and a grip 66 as shown, for example, in FIG. 4. First step link 60 is pivotably coupled to top step 18 on one end and to anchor rung 52 on another end as suggested in FIG. 4. Link 60 is configured to cause a "free" end 18*f* of top step 18 to pivot toward step frame 12 upon movement of frames 12, 14 from the expanded use position of FIG. 1 toward the collapsed storage position of FIG. 3.

Pivotable latch 34 is pivoted toward step frame 12 to cause camming movement of first and second latch hooks 64 on anchor rung 52 during movement from an unlocked position above horizontal anchor rung 52 toward a pivoted position alongside anchor rung 52 and then toward an engaged position below anchor rung 52. Step lock 30 also includes a latch-biasing return spring 63 arranged to engage pivotable latch 34.

Stepladder 10 is changeable between the expanded use position, shown in FIG. 1, and the collapsed storage position shown, with portions broken away, in FIG. 3. In the expanded use position, step frame 12 is spaced apart from stabilizer frame 14. In the collapsed storage position, right leg 22 and first support member 48 are arranged to lie adjacent to each other and left leg 20 and second support member 50 are arranged to lie adjacent to each other, as shown in FIG. 3.

In operation, to "change" stepladder 10 from the expanded use position to the collapsed storage position, the user first moves pivotable latch 34 from the locked position to the unlocked position by grasping grip 66 and pivoting grip 66 toward step frame 12 and away from stabilizer frame 14 against a latch-biasing force provided by return spring 65 to disengage latch hooks 64 from anchor rung 52. When latch hooks 64 have disengaged from anchor rung 52, the user is able to move a free end 18F of top step 18 toward step frame 12 as suggested in FIGS. 2 and 3.

As latch 34 and top step 18 are moved toward step frame 12, first step link 60 urges stabilizer frame 14 to pivot about frame pivot axis 58 in a direction 68 and urges second step links 38 to move in a direction 70 so that step 19 pivots about a lower-step axis 45 to move toward a position substantially parallel to step frame 12 and positioned to lie between left and right legs 20, 22 as suggested in FIGS. 2 and 3. Similarly, top step 18 pivots about a top-step pivot axis 42 in direction 72 to move toward a position substantially parallel to step frame 12 and positioned to lie between left and right legs 20, 22 as suggested in FIGS. 2 and 3. Simultaneously, stabilizer frame 14 is moved in a direction 68 to lie substantially parallel to step frame 12 to establish the collapsed storage position shown in FIG. 3.

In an illustrative embodiment, an upper surface 104 of interior plate 90 of utility tray 16 may be formed to include a container receiver 106 and implement receivers 108 configured to receive and hold various items that a user may be working with, for example, to perform household chores as shown in FIGS. 1-3. Since utility tray 16 is movable independent of any folding action of step frame 12 and stabilizer frame 14, a user may choose to maintain utility tray 16 in the retracted storage position of FIG. 3 to use such, for example, as a "grab" bar to assist in maintaining balance.

Each of hinges 56, 57 included in stabilizer frame 14 of foldable stepladder 10 is also formed to include an accessory mount 112 as suggested in FIG. 4. Accessory mount 112 is configured to mate with and support a stepladder accessory such as a power-cord hook or other holder or clamp. In an illustrative embodiment shown in FIGS. 11-13, an accessory mount 112 is included in hinge 56 and configured to mate with and support, one at a time, each of the stepladder accessories included in accessory kit 150.

In an illustrative embodiment, each of hinges 56, 57 includes a hinge pin 133, a hinge-pin mount 110 configured to mate with hinge pin 133, and an accessory mount 112 coupled to a companion hinge-pin mount 110. In an illustrative embodiment, hinge-pin mount 110 and accessory mount 112 cooperate to form a monolithic component made of a molded plastics material.

As suggested in FIGS. 4 and 12, hinge-pin mount 110 is formed to include hinge-pin aperture(s) 131 sized to receive hinge pin 133 therein. Apertures 131 are aligned with hinge-pin apertures 129 formed in leg 22 of step frame 12 and a hinge-pin aperture 127 formed in upper portion 54 of support member (leg) 48 of stabilizer frame 14 as suggested in FIG. 12.

Hinge-pin mount 110 also includes a top wall 125 formed to include a leg-receiver aperture 123 sized to receive a portion of leg 22 therein as suggested in FIGS. 4 and 12. Hinge-pin mount 110 also includes a downwardly opening funnel-shaped side wall 121 depending from a perimeter edge of top wall 125. Leg 22 is sized and shaped to extend into an interior region 119 formed in hinge-pin mount 110 and defined by top and side walls 125, 121 as suggested in FIG. 12.

Hinge-pin mount 110 is configured to slide downwardly on leg 22 in direction 117 as suggested in FIG. 12 to align hinge-pin apertures 131 formed in funnel-shaped side wall 121 with hinge-pin apertures 129, 127 formed in legs 22, 48 as suggested in FIGS. 12 and 13. Once apertures 127, 129, 131 are aligned, hinge pin 133 can be passed through the apertures 127, 129, 131 to establish a pivot axis 98 about which stabilizer frame 14 pivots relative to step frame 12 during relative movement of frames 12, 14 as suggested in FIGS. 1-3. Upper portion 54 of support member 48 is housed in interior region 119 of hinge-pin mount 110 when hinge-pin mount 110 is anchored in place as suggested in FIGS. 12 and 13.

Side wall 121 provides means for limiting angular separation of support member 48 of stabilizer frame 14 relative to leg 22 of step frame 12 as suggested in FIGS. 1 and 2. Support member 48 contacts an inner surface of side wall 121 to limit splaying motion of support member 48 relative to companion leg 22. Such splaying motion is also limited by engagement of step 18 with rung 52 as suggested in FIG. 1.

Accessory mount 112 includes a mount plate 153 formed to include a neck-receiving slot 126 and first and second stand-off plates 151, 152 as shown, for example, in FIGS. 12 and 13. First stand-off plate 151 is rooted on funnel-shaped side wall 121 of hinge-pin mount 110 and coupled to one edge of mount plate 153 while second stand-off plate 152 is rooted on funnel-shaped side wall 121 and coupled to another edge of mount plate 153 to cause side wall 121, mount plate 153, and first and second stand-off plates 152 to cooperate to form a base receptacle 128 sized to receive a (common) base 101 included in each of the stepladder accessories included in accessory kit 150.

As shown, for example, in FIGS. 12 and 13, a utility hook 105 is one example of a stepladder accessory included in accessory kit 150. Utility hook 105 comprises a base 101 and a "tool holder" comprising a carrier such as a hanger 114 and a neck 115 interconnecting base 101 and hanger 114. Neck 115 is sized to fit into neck-receiving slot 126 when base 101 is deposited into and retained in base receptacle 128 formed in accessory mount 112 to support the tool holder 114, 115 in a fixed position on hinge-pin mount 110. In illustrative embodiments, (common) base 101 comprises vertical plate 161, top plate 162, and bottom plate 163 as suggested in FIGS. 12 and 13. Vertical plate 161 is arranged to interconnect top and bottom plates 162, 163 and is coupled to neck 115.

Accessory mount 112 is configured to provide a mounting platform for numerous assistance devices such as a utility hook 105 having a carrier such as a hook 114 coupled to common base 101 by neck 115, a paper towel holder 107 having a carrier such as a roll holder 116 coupled to common base 101. Other accessories may include a power cord hook 109 having a carrier such as a hook 118 coupled to common base 101 by neck 115", a tape measure 111 having a carrier such as a tape measure reel 120 coupled to common base 101 by neck 115''', or a utility holder 113 having a carrier such as a receptacle 122 coupled to common base 101 by neck 115'''' and configured to hold various implements as needed by the user.

The invention claimed is:

1. A stepladder comprising a frame unit including steps, a utility tray, tray-controller means for supporting the utility tray for pivoting movement about a pivot axis during a first stage of movement relative to the frame unit and for sliding movement relative to the pivot axis during a second stage of movement relative to the frame unit so that the utility tray can be moved by a user relative to the frame unit, in sequence, from a horizontal use position pivoting through an acute angle to attain an extended intermediate position, and then moving along an inclined path to attain a retracted storage position, and wherein the utility tray is formed to include first and second post-receiver slots, the tray controller means includes a first tray mount that includes a first pivot post attached directly to a first leg of the frame, the first pivot post arranged to extend into the first post-receiver slot for movement therein, the tray controller means further includes a second tray mount that includes a second pivot post attached directly to a second leg of the frame, the second pivot post arranged to extend into the second post-receiver slot for movement therein and arranged to lie in axial alignment with the first pivot post to establish the pivot axis, each of the first and second post-receiver slots respectively has a first post receiver in a back end portion of the utility tray and a second post receiver formed in an opposite front end portion of the utility tray, the first pivot post lies within the first post receiver in the first post-receiver slot and the second pivot post lies within the first post receiver of the second post-receiver slot upon movement of the utility tray to attain each of the horizontal use position and the extended intermediate position, and the first pivot post lies within the second post receiver in the first post-receiver slot and the second pivot post lies within the second post-receiver in the second post-receiver slot upon movement of the utility tray to attain the retracted storage position alongside the step frame.

2. A stepladder comprising a foldable frame unit including a step frame including spaced-apart first and second legs and steps coupled to the first and second legs, and a stabilizer frame coupled to the step frame for folding movement between an expanded use position away from the step frame to a collapsed storage position alongside the step frame, a utility tray, tray-controller means for supporting the utility tray for pivoting movement about a pivot axis, the tray moving relative to the step frame through an acute angle during a first stage of movement from a horizontal use position oriented to lie at an obtuse angle to the step frame to an extended intermediate position oriented to project upwardly away from the step frame and for sliding movement relative to the pivot axis during a second stage of movement from the extended intermediate position to a retracted storage position oriented to lie alongside the step frame, wherein the utility tray can moved relative to the step frame by a user, in series, among the horizontal use position, the extended intermediate position, and the retracted storage position independent of any folding action of the step and stabilizer frames included in the foldable frame unit, wherein the tray-controller means includes a first tray mount coupled to the first leg of the step frame and a second tray mount coupled to the second leg of the step frame, the first and second tray mounts lie in spaced-apart relation to one another and at least a portion of the utility tray lies in a space provided between the first and second tray mounts upon movement of the utility tray to each of the horizontal use, extended intermediate, and retracted storage positions, and wherein the utility tray is formed to include first and second post-receiver slots, the first tray mount includes a first pivot post attached directly to the first leg and extending into the first post-receiver slot for movement therein, the second tray mount includes a second pivot post attached directly to the second leg and extending into the second post-receiver slot for movement therein and to lie in axial alignment with the first pivot post to establish the pivot axis, each of the first and second post-receiver slots has a respective first post receiver in a back end portion of the utility tray and a respective second post receiver formed in an opposite front end portion of the utility tray, the first pivot post lies within the respective first post receiver in the first post-receiver slot and the second pivot post lies within the respective first post receiver of the second post-receiver slot upon movement of the utility tray to attain each of the horizontal use position and the extended intermediate position and the first pivot post lies within the respective second post receiver in the first post-receiver slot and the second pivot post lies within the respective second post-receiver in the second post-receiver slot upon movement of the utility tray to attain the retracted storage position alongside the step frame.

3. The stepladder of claim 2, wherein each of the first and second tray mounts includes a horizontal surface arranged to mate with and support the utility tray at the obtuse angle relative to the step frame upon movement of the utility tray to attain the horizontal use position, and each of the first and second tray mounts respectively includes an inclined surface arranged to cooperate with the horizontal surface to define an obtuse angle therebetween and to mate with and support the utility tray for sliding movement along the step frame between the extended intermediate position and the retracted storage position.

4. The stepladder of claim 3, wherein the first tray mount includes a cap retained in a fixed position on the first leg of the step frame and a tray brace appended to the cap and configured to include the horizontal and inclined surfaces.

5. The stepladder of claim 3, wherein the utility tray is formed to include a first post-receiver slot, the first tray mount includes a cap retained in a fixed position on the first leg of the step frame and a first pivot post coupled to the cap and arranged to extend away from the cap and into the first post-receiver slot for movement therein during movement of the utility tray relative to the step frame between the extended intermediate position and the retracted storage position, and the first pivot post is arranged to lie in spaced-apart relation to the respective inclined surface to allow a portion of the utility tray to move in a space provided between the first pivot post and the respective inclined post during sliding movement of the utility tray between the extended intermediate position and the retracted storage position.

6. The stepladder of claim 2, wherein the utility tray is formed to cause the first post-receiver slot to include an elongated guide channel extending between and interconnecting the respective first and second post receivers and receiving the first pivot post therein to provide means for guiding the utility tray along an inclined path relative to the step frame during sliding movement of the utility tray relative to the first pivot post and the step frame from the extended intermediate position to the retracted storage position.

7. The stepladder of claim 6, wherein the utility tray is also formed to include detent means located between the respective first post receiver and the elongated guide channel for temporarily retaining the first pivot post in the respective first post receiver while the utility tray is oriented to lie in the horizontal use position and during the first stage of movement of the utility tray relative to the step frame as the utility tray pivots about the pivot axis between the horizontal use position and the extended intermediate position.

8. The stepladder of claim 6, wherein the utility tray is also formed to include detent means located between the elongated guide channel and the respective second post receiver for temporarily retaining the first pivot post in the respective second post receiver after sliding movement of the utility tray relative to the step frame along the inclined path and after arrival of the utility tray at the retracted storage position to block unwanted relative movement of the utility tray with respect to the step frame.

9. A stepladder comprising a step frame including first and second legs and step coupled to the first the and second legs, a stabilizer frame coupled to the step frame for pivotable movement about an axis of rotation occurring between an expanded use position arranged to lie in splayed relation to the step frame and a collapsed storage position arranged to lie alongside the step frame, a tray unit including a utility tray configured to have a first post-receiver slot, a first tray mount coupled to the first leg and arranged to mate with the utility tray during pivoting and sliding movement of the utility tray relative to the first leg, and a second tray mount coupled to the second leg and arranged to mate with the utility tray during pivoting and sliding movement of the utility tray relative to the second leg, and wherein the first tray mount includes a first cap directly coupled to the first leg, wherein the first cap includes a tray brace having a horizontal surface configured and aligned to mate with and support the utility tray upon movement of the utility tray relative to the step frame to attain a horizontal use position, the horizontal surface arranged to lie at an obtuse angle relative to the step frame, the tray brace further includes an inclined surface configured and aligned to mate with and support the utility tray for sliding movement along the step frame from an extended intermediate position wherein the utility tray extends upwardly beyond the first tray mount to a retracted storage position wherein the utility tray lies alongside the step frame, the first cap further having a first pivot post arranged to extend into and remain in the first post-receiver slot of the tray during pivoting and sliding movement of the utility tray relative to the step frame.

10. The stepladder of claim 9, wherein the utility tray is formed to include a first post receiver at one end of the first post-receiver slot and the first pivot post is arranged to extend into and remain in the first post receiver during pivotable movement of the utility tray occurring between the horizontal use position and the extended intermediate position, the pivotable movement being about a pivot axis, the pivot axis being established by the first pivot post located away from the horizontal surface of the first tray mount.

11. The stepladder of claim 10, wherein the utility tray is formed to include a second post receiver at another end of the first post-receiver slot and the first pivot post is arranged to extend into the second post receiver upon arrival of the utility tray at the retracted storage position.

12. The stepladder of claim 9, wherein the utility tray is formed to include a first post receiver at one end of the first post-receiver slot and the first pivot post is arranged to extend into and remain in the first post receiver during pivotable movement of the utility tray occurring between the horizontal use position and the extended intermediate position, pivotable movement being about a pivot axis, the pivot axis being established by the first pivot post located away from the horizontal surface of the first tray mount, the utility tray is formed to include a second post receiver at another end of the first post-receiver slot and the first pivot post is arranged to extend into the second post receiver upon arrival of the utility tray at the retracted storage position, and the utility tray is also formed to include an elongated guide channel interconnecting the first and second post receivers and receiving the first pivot post therein during sliding movement of the utility tray on the inclined surface between the extended intermediate position and the retracted storage position.

13. The stepladder of claim 9, wherein the utility tray is formed to include a first post receiver at one end of the first post-receiver slot and the first pivot post is arranged to extend into and remain in the first post receiver during pivotable movement of the utility tray occurring between the horizontal use position and the extended intermediate position, pivotable movement being about a pivot axis, the pivot axis being established by the first pivot post located away from the horizontal surface of the first tray mount, the utility tray is formed to include a second post receiver at another end of the first post-receiver slot and the first pivot post is arranged to extend into the second post receiver upon arrival of the utility tray at the retracted storage position, and the utility tray is also formed to include an elongated guide channel interconnecting the first and second post receivers and receiving the first pivot post therein during sliding movement of the utility tray on the inclined surface between the extended intermediate position and the retracted storage position, and wherein the utility tray further includes first detent means located between the first post receiver and the elongated guide channel for temporarily retaining the first pivot post in the first post receiver while the utility tray is oriented to lie in the horizontal use position and during a first stage of movement of the utility tray relative to the step frame as the utility tray pivots about the pivot axis between the horizontal use position and the extended intermediate position, and the utility tray further includes a second detent means located between the elongated guide channel and the second post receiver for temporarily retaining the first pivot post in the second post receiver after sliding movement of the utility tray relative to the step frame along an inclined path and after arrival of the utility tray at the retracted storage position to block unwanted relative movement of the utility tray with respect to the step frame.

14. The stepladder of claim 9, wherein the utility tray is formed to include the first post-receiver slot and the first mount includes the first cap coupled to the first leg of the step frame, and the first cap is coupled to the first pivot post which is arranged to extend into and remain in the first-post receiver slot during pivoting and sliding movement of the utility tray relative to the step frame.

15. The stepladder of claim 14, wherein the utility tray is formed to include a first post receiver at one end of the first post-receiver slot and the first pivot post is arranged to extend into and remain in the first post receiver during pivotable movement of the utility tray occurring between the horizontal use position and the extended intermediate position, pivotable movement being about a pivot axis, the pivot axis being established by the first pivot post located away from the horizontal surface of the first tray mount.

16. The stepladder of claim 9, wherein the stabilizer frame includes a first support member and a first hinge coupled to the first leg and to the first support member, the first hinge includes a hinge pin coupled to the first leg and to the first support member to provide means for supporting the first support member for pivotable movement about the axis of rotation between the expanded use position and the collapsed storage position, and the first hinge also includes a hinge-pin mount coupled to the hinge pin to support the hinge pin in coextensive relation to an axis of rotation and an accessory mount coupled to the hinge-pin mount and formed to include a base receptacle, and further comprising a stepladder accessory including a tool holder and a base coupled to the tool holder and located in the base receptacle of the accessory mount to support the tool holder in a fixed position on the hinge-pin mount.

17. The stepladder of claim 16, wherein the hinge-pin mount includes a top wall formed to include a leg-receiver aperture receiving a portion of the first leg of the step frame therein and a downwardly opening funnel-shaped side wall depending from the top wall and surrounding mating portions of the first leg of the step frame and the first support member of the stabilizer frame and wherein the funnel-shaped side wall is formed to include a hinge-pin aperture receiving a portion of the hinge pin therein.

18. The stepladder of claim 17, wherein the accessory mount further includes a mount plate formed to include a neck-receiving slot and a stand-off plate coupled to the funnel-shaped side wall and to the mount plate to separate the mount plate from the funnel-shaped side wall to define the base receptacle located between the mount plate and the funnel-shaped side wall, and the tool holder includes a carrier and a neck arranged to interconnect the base and the carrier and to lie in the neck-receiving slot formed in the mount plate when the base is located in the base receptacle to hold the carrier in a stationary position relative to the hinge-pin mount outside the base receptacle.

19. The stepladder of claim 9, wherein the step frame further includes a mount rung associated with each step and arranged to extend between and interconnect the first and second legs of the step frame, each step is formed to include a rung receiver receiving therein an associated one of the mount rungs, and the step frame further includes retainer means coupled to each step for retaining the companion mount rung in the rung receiver formed in said step yet allowing pivoting movement of said step about a pivot axis established by the mount rung during movement of the stabilizer frame relative to the step frame between the expanded use position and the collapsed storage position, wherein the retainer means includes a strap arranged to trap a companion mount rung in an associated rung receiver and a fastener coupled to an associated strap and an associated step to retain the strap in a stationary position on the companion step.

* * * * *